US006818832B2

(12) United States Patent
Hopkinson et al.

(10) Patent No.: US 6,818,832 B2
(45) Date of Patent: Nov. 16, 2004

(54) NETWORK CABLE WITH ELLIPTICAL CROSSWEB FIN STRUCTURE

(75) Inventors: Wayne C. Hopkinson, Buford, GA (US); David Allyn Wiebelhaus, Omaha, NE (US)

(73) Assignee: Commscope Solutions Properties, LLC, Sparks, NV (US)

( * ) Notice: Subject to any disclaimer, the term of this patent is extended or adjusted under 35 U.S.C. 154(b) by 0 days.

(21) Appl. No.: 10/127,401

(22) Filed: Apr. 22, 2002

(65) Prior Publication Data

US 2003/0159848 A1 Aug. 28, 2003

Related U.S. Application Data

(60) Provisional application No. 60/360,083, filed on Feb. 26, 2002.

(51) Int. Cl.[7] ..... H01B 7/00
(52) U.S. Cl. ..... 174/113 R; 174/113 C
(58) Field of Search ..... 174/110 R, 113 R, 174/113 C, 120 R, 113 AS

(56) References Cited

U.S. PATENT DOCUMENTS

| | | | | | |
|---|---|---|---|---|---|
| 1,940,917 | A | * | 12/1933 | Okazaki | 174/113 C |
| 5,132,488 | A | * | 7/1992 | Tessier et al. | 174/34 |
| 5,789,711 | A | * | 8/1998 | Gaeris et al. | 174/113 C |
| 5,952,615 | A | * | 9/1999 | Prudhon | 174/113 C |
| 5,969,295 | A | * | 10/1999 | Boucino et al. | 174/113 C |
| 6,150,612 | A | * | 11/2000 | Grandy et al. | 174/113 C |
| 6,211,467 | B1 | * | 4/2001 | Berelsman et al. | 174/113 R |
| 6,239,363 | B1 | * | 5/2001 | Wooters | 174/47 |
| 6,239,379 | B1 | * | 5/2001 | Cotter et al. | 174/110 R |
| 6,248,954 | B1 | * | 6/2001 | Clark et al. | 174/113 R |
| 6,297,454 | B1 | * | 10/2001 | Gareis | 174/113 C |
| 6,310,295 | B1 | * | 10/2001 | Despard | 174/113 R |
| 6,365,836 | B1 | * | 4/2002 | Blouin et al. | 174/113 C |
| 6,506,976 | B1 | * | 1/2003 | Neveux, Jr. | 174/113 R |

FOREIGN PATENT DOCUMENTS

| | | | | |
|---|---|---|---|---|
| EP | 1 162 632 A | * | 12/2001 | H01B/11/04 |
| JP | 60-61708 A | * | 9/1985 | G02B/6/44 |
| JP | 04-332406 A | * | 11/1992 | H01B/7/04 |

OTHER PUBLICATIONS

Glew et al, High Performance Support Separator for Communications Cable, US2003/0037955 A1.*
M.J. Riezenman, "Subtle Twists Refine Lowly Twisted–Pair," IEEE Spectrum, p. 19, Mar. 2002.

* cited by examiner

*Primary Examiner*—William H. Mayo, III
(74) *Attorney, Agent, or Firm*—Meyers Bigel Sibley & Sajovec

(57) ABSTRACT

A network cable including a plurality of conductors and an associated crossweb having one or more fins of substantially elliptical cross-sectional shape. The crossweb runs longitudinally along at least a portion of a length of the conductors, and includes a central region approximately in a center of the cable and a plurality of fins extending outwardly from the central region, with a given one of the fins separating at least a first one of the conductors from at least a second one of the conductors. At least the given one of the fins has a variable thickness along a cross-sectional length thereof from the central region to an opposing end of the fin with a maximum of the variable thickness being in a portion of the fin between the central region and the opposing end of the fin.

16 Claims, 3 Drawing Sheets

Prior Art

NETWORK CABLE WITH ELLIPTICAL CROSSWEB FIN STRUCTURE

RELATED APPLICATION(S)

The present application claims the priority of U.S. Provisional Application Ser. No. 60/360,083 filed Feb. 26, 2002 in the name of inventors Wayne C. Hopkinson and David A. Wiebelhaus and entitled "Network Cable with Elliptical Crossweb Fin Structure."

FIELD OF THE INVENTION

The invention relates generally to the field of network transmission media, and more particularly to network cables which include multiple conductors.

BACKGROUND OF THE INVENTION

Conventional network cables that include multiple conductor pairs generally also include a crossweb which is designed to maintain a fixed separation between the multiple conductor pairs so as to reduce crosstalk. The crossweb is also commonly referred to as a "flute." By way of example, in a conventional network cable of a type commonly known as a "Category 6" cable, as described in ANSI/EIA/TIA-568.B2, which is hereby incorporated by reference herein, there are four twisted pairs and a crossweb which is arranged between the twisted pairs. The crossweb typically includes a central region at the center of the cable and fins extending from the central region to separate the twisted pairs from one another.

A significant problem that can arise when using a crossweb in a Category 6 cable or other type of network cable relates to the amount of material required to implement the crossweb. Crosstalk reduction may dictate that the crossweb fins have a designated thickness. However, increasing the thickness of the crossweb fins in order to improve the crosstalk performance of the cable is generally not desirable for many cable designs because the extra material may degrade burn performance, which can result in the cable not meeting designated fire safety performance standards. This is particularly problematic for cables that must meet fire safety ratings such as the well-known Communications Plenum Cable (CMP) or Nonhalogen International Electrotechnical Commission (IEC) 60332 Part 3C ratings. Increasing the thickness of the crossweb fins also increases the cost and size of the cable, while reducing its flexibility. Conventional cables with standard crossweb shapes fail to optimize material usage to achieve the best electrical, physical and fire safety performance.

A need therefore exists for an improved network cable which can provide a reduction in crosstalk without significantly increasing the amount of material used to implement the crossweb, thereby meeting fire safety, cost, size and flexibility requirements.

SUMMARY OF THE INVENTION

The invention provides a network cable having an improved crossweb structure which overcomes one or more of the above-specified drawbacks of conventional cables.

In accordance with one aspect of the invention, a network cable comprises a plurality of conductors, and a crossweb running longitudinally along at least a portion of a length of the conductors. The crossweb has a central region approximately in a center of the cable and a plurality of fins extending outwardly from the central region, with a given one of the fins separating at least a first one of the conductors from at least a second one of the conductors. At least the given one of the fins has a variable thickness along a cross-sectional length thereof from the central region to an opposing end of the fin with a maximum of the variable thickness being in a portion of the fin between the central region and the opposing end of the fin. For example, in an illustrative embodiment of the invention, each of the fins of the crossweb has a substantially elliptical shape along its cross-sectional length.

In accordance with another aspect of the invention, the maximum thickness of a given one of the fins may substantially correspond to a center of a corresponding one of the conductors, e.g., a center of a twisted pair conductor. The variable thickness along the cross-sectional length of the given one of the fins may increase from a portion of the fin adjacent the central region of the crossweb to a maximum thickness near a center of an associated one of the conductors, and decrease from the maximum thickness near the center of the associated one of the conductors to an end of the fin away from the central region. The variable thickness may be at a minimum thickness at the portion of the fin adjacent the central region of the crossweb.

Advantageously, the invention can provide a reduction in crosstalk in a network cable without requiring a corresponding increase in crossweb material, and thus without negatively impacting the fire safety, cost, size and flexibility requirements of the cable.

DETAILED DESCRIPTION OF THE INVENTION

The present invention will be illustrated in conjunction with an example crossweb configuration particularly well-suited for use with a Category 6 network cable. It should be understood, however, that the invention is more generally suitable for use with any multiple-conductor cable that utilizes a crossweb having multiple fins.

In an illustrative embodiment of the invention, a network cable crossweb is configured so as to utilize a substantially elliptical shape for one or more fins of the crossweb. Advantageously, the use of elliptical shaped fins in accordance with the invention can maximize the material thickness between conductor pairs to improve spacing and therefore crosstalk performance. In addition, the improved crosstalk performance is achieved without increasing the crossweb material requirements of the cable. The invention involves transferring crossweb material from portions of the fins where it is not needed to other portions of the fins where it is of optimal utility in reducing crosstalk. This allows the maximum crosstalk reduction without the need for additional crossweb material, and thus without the previously-described concerns relating to fire safety, cost, size and flexibility. In fact, the improved crossweb configuration of the present invention can actually improve cable flexibility, while also reducing crosstalk and meeting fire safety, cost and size requirements.

Figure 1:
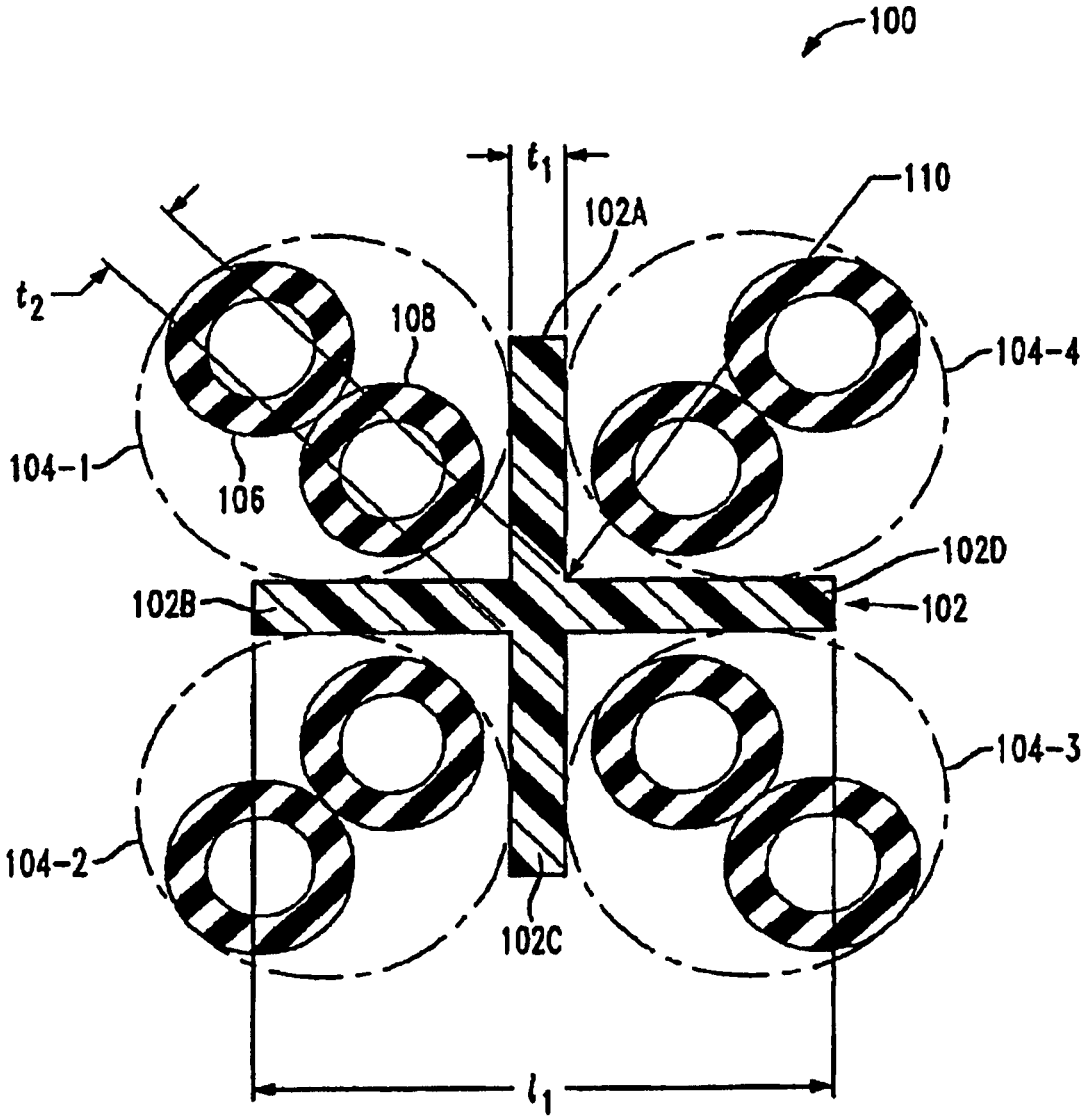
FIG. 1 shows a cross-sectional view of an example network cable in which the present invention may be implemented.

FIG. 1 shows a cross-sectional view of a Category 6 cable of a type in which the present invention may be implemented. The cable 100 in this example includes a crossweb 102 and four twisted pair conductors 104-1, 104-2, 104-3 and 104-4. Each of the twisted pairs 104 includes a first conductor 106 and a second conductor 108. Although the individual conductors 106, 108 of a given twisted pair 104 are shown as including a sheathing or jacket, there is no jacket around the twisted pair itself. The dashed circles around each twisted pair 104 are intended to illustrate a diameter of the corresponding pair. It should also be noted that the cable 100 will generally include a jacket arranged around the set of pairs and crossweb, as is well known, although this exterior jacket is eliminated from the drawings for simplicity and clarity of illustration. Additional details regarding these and other aspects of the cable 100 may be obtained by reference to the above-cited Category 6 specification, ANSI/EIA/TIA-568.B2.

In longitudinal dimension, although not shown in the drawings, the crossweb typically runs along the length of the conductor pairs, and the pairs may be terminated on either end using conventional jack or plug terminations. These and other conventional aspects of Category 6 cables and other cables suitable for use with the present invention are well understood by those skilled in the art and therefore not described in further detail herein.

The crossweb 102 in the FIG. 1 embodiment includes a central region indicated generally at 110 and four fixed-width fins 102A, 102B, 102C and 102D extending from the central region to separate the conductor pairs 104-1, 104-2, 104-3 and 104-4 from one another as shown. Each of the fins has a fixed thickness along its length from the central region 110 to an opposing end of the fin. This thickness, denoted by $t_1$ in FIG. 1, is typically about 0.015 inches. The thickness $t_2$ of the central region 110 is typically about 0.0212 inches. The length $l_1$ from the end of one fin 102B to the end of another fin 102D is typically about 0.145 inches. As a result of the fixed thickness of the fins 102A, 102B, 102C and 102D, the central region includes four sharp corners as shown.

As indicated previously, a fixed-thickness crossweb of a type such as crossweb 102 of FIG. 1 generally does not provide an optimal material usage to achieve the best electrical, physical and fire safety performance for the cable.

Figure 2:
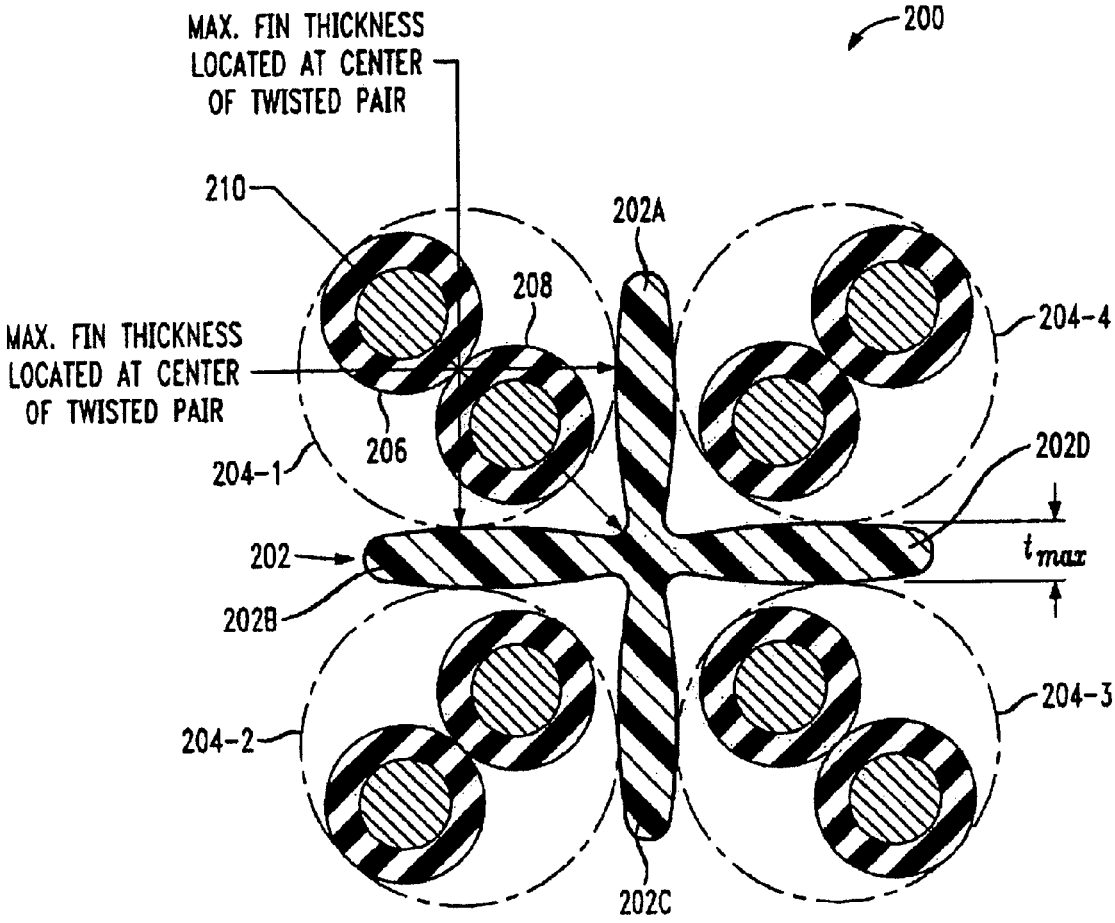
FIG. 2 shows a cross-sectional view of a network cable configured with a substantially elliptical crossweb fin structure in accordance with an illustrative embodiment of the invention.

FIG. 2 shows an illustrative embodiment of the invention in which the fixed-thickness crossweb 102 is replaced with a variable-thickness crossweb configured in accordance with the invention. The cable 200 in this embodiment includes a crossweb 202 and four twisted pair conductors 204-1, 204-2, 204-3 and 204-4. Each of the twisted pairs 204 includes a first conductor 206 and a second conductor 208. As in the previous figure, although the individual conductors 206, 208 of a given twisted pair 204 are shown in FIG. 2 as including a sheathing or jacket, there is no jacket around the twisted pair itself. The dashed circles around each twisted pair 204 are intended to illustrate a diameter of the corresponding pair. Although not shown in the cross-sectional view of FIG. 2, the crossweb 202 runs longitudinally along at least a portion of a length of the conductors 204, as will be appreciated by those skilled in the art.

The crossweb 202 in the FIG. 2 embodiment includes a central region indicated generally at 210 and four fins 202A, 202B, 202C and 202D extending from the central region to separate the conductor pairs 204-1, 204-2, 204-3 and 204-4 from one another as shown. The central region 210 of the crossweb is located approximately in a center of the cable 200.

In accordance with the invention, each of the fins has a variable thickness along its cross-sectional length from the central region 210 to an opposing end of the fin. In this cross-sectional view, the fins are substantially elliptical in shape along the cross-sectional length thereof as a result of the variable thickness. A maximum thickness $t_{max}$ of the variable thickness along the cross-sectional length from the central region 210 to the opposing end of the fin is in a portion of the fin between the central region and the opposing end of the fin. More particularly, the maximum thickness $t_{max}$ is provided in a portion of the fin which substantially coincides with a center of the corresponding twisted pair 204, as is shown in the figure.

It should be noted that in this context, the term "center" refers not to the center of a particular individual conducting wire, but instead to a center of a dashed circle that is shown in the figure as defining a region associated with a given twisted pair 204. The term "center" as used herein is therefore intended to be construed generally so as to cover such an arrangement, as well as other arrangements such as the center of an individual conductor in an alternative embodiment.

The substantially elliptical shape of the fins 202A, 202B, 202C and 202D in the FIG. 2 embodiment optimizes the crosstalk performance of adjacent pairs while also maximizing fire safety performance. The transfer of material from the central region of the web to the portion of the fin near the center of the twisted pairs also serves to improve the flexibility of the cable relative to the FIG. 1 crossweb configuration, as was indicated previously. The shape of the central region 210 in FIG. 2 provides a smooth transition between fins and adds strength at the center of the crossweb, without the need for additional crossweb material.

The maximum thickness $t_{max}$ in a Category 6 implementation may be nominally about 0.017 inches. The maximum thickness $t_{max}$ is preferably in a range of approximately 0.008 inches to 0.050 inches.

Figure 3:
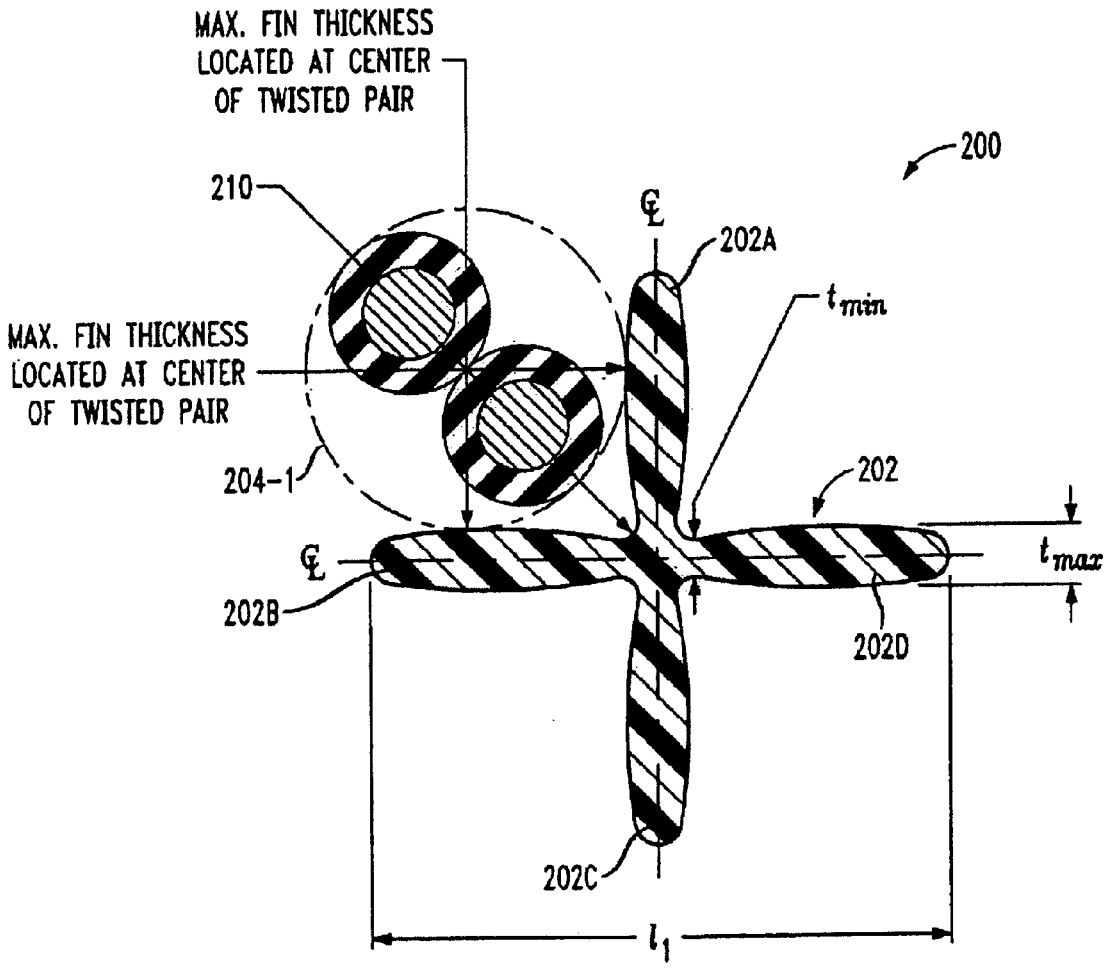
FIG. 3 illustrates certain additional dimensions for the network cable of FIG. 2.

Additional dimensions of the crossweb 102 will now be described with reference to FIG. 3. In this figure, the centerlines (CL) of the crossweb fins are shown. The minimum thickness $t_{min}$ is provided in a portion of the fin adjacent the central region 210. The variable thickness along the cross-sectional length of a given fin thus increases from the minimum thickness $t_{min}$ in the portion of the fin adjacent the central region 210, to the maximum thickness $t_{max}$ near a center of an associated one of the twisted pair conductors 204, and decreases from the maximum thickness to an end of the fin away from the central region 210.

The minimum thickness $t_{min}$ in a Category 6 implementation may be nominally about 0.010 inches. The minimum thickness $t_{min}$ is preferably in a range of approximately 0.004 inches to 0.025 inches.

The length $l_1$ from the end of one fin 202B to the end of another fin 202D in a Category 6 implementation may be about 0.145 inches. The length $l_1$ is preferably in a range of approximately 0.100 inches to about 1.000 inches.

The rounded portion of the central region 210 between adjacent fins is referred to herein as a "fillet" and may have a nominal radius dimension of about 0.005 inches, i.e., 0.005R. An approximate range for this fillet may be from zero, corresponding to no fillet or a sharp edge as in the FIG. 1 crossweb, to about 0.125R inches.

It is to be appreciated that the particular dimensions given herein are byway of example only, and should not be construed as limiting the scope of the invention in any way.

The crossweb 202 may be constructed of materials such as fluoropolymers, polyvinyl chloride (PVC), polyolefins, zero halogen compounds, or other suitable materials as well as combinations of such materials. Examples of fluoropolymers include fluorinated ethylene-propylene (FEP), methylfluoroalkoxy (MFA) and perfluoroalkoxy (PFA). Examples of PVC include flexible PVC, non-lead flexible PVC and low smoke flexible PVC. Examples of polyolefins include polypropylene and polyethylene, and fire-retarded polyolefins such as fire-retarded polypropylene and fire-retarded polyethylene. Examples of zero halogen compounds include low smoke zero halogen compounds (LSZH) such as EVA (ethylene vinyl alcohol and/or ethylene vinyl acetate) based LSZH materials. It should be understood, however, that the invention does not require the use of any particular crossweb material.

Although the invention is illustrated herein using twisted pairs each having two individual conductors, this is by way of example only. The invention does not require the use of twisted pairs, and non-twisted pairs or single conductors can be used. The term "conductor" as used herein is therefore intended to include a twisted pair, a non-twisted pair, a single conductor, or other arrangements of conductors.

In addition, the particular number of conductors used in the illustrative embodiments should not be viewed as requirements of the invention. For example, the invention can be implemented in a cable which has more or less than the four twisted pairs used in the FIG. 2 embodiment. Another example is a 25-pair cable arranged in four four-pair groups and three three-pair groups. In such an arrangement, a crossweb such as that shown in FIG. 2 can be used in each of the four-pair groups, with the three-pair groups not using a crossweb. As another example, the techniques of the invention can be applied to a crossweb for a three-pair group.

The particular number of fins shown in the illustrative embodiments can also be varied in other embodiments, i.e., more or less than four fins may be used in a crossweb configured in accordance with the invention. Furthermore, although the same substantially elliptical shape is used for each of the fins in the FIG. 2 embodiment, other embodiments may use different shapes for different ones of the fins, or other shapes which achieve the performance objectives of the present invention but which are otherwise not substantially elliptical in shape.

Advantageously, the crossweb configuration in the illustrative embodiment is less expensive than conventional configurations, and provides improved crosstalk performance without requiring a corresponding increase in the amount of crossweb material.

It should again be emphasized the above-described embodiments are illustrative only. For example, as indicated previously, alternative embodiments of the invention may utilize other cable and conductor arrangements, crossweb configurations, dimensions, materials, etc. These and numerous other alternative embodiments within the scope of the following claims will be apparent to those skilled in the art.

What is claimed is:

1. A cable comprising:

a plurality of twisted pairs of conductors; and a crossweb running longitudinally along at least a portion of a length of the twisted pairs of conductors, the crossweb having a central region approximately in a center of the cable and a plurality of fins extending outwardly from the central region, a given one of the fins separating at least a first one of the twisted pairs of conductors from at least a second one of the twisted pairs of conductors;

wherein at least the given one of the fins has a substantially elliptical shape and a variable thickness along a cross-sectional length thereof from the central region to an opposing end of the fin with a maximum of the variable thickness being in a portion of the fin between the central region and the opposing end of the fin aligned with the cross-sectional centers of the twisted pairs of conductors between which the fin resides.

2. The cable of claim 1 wherein the plurality of twisted pairs of conductors comprises four twisted pairs of conductors, and the crossweb comprises four fins, with each of the four twisted pairs of conductors being arranged between a pair of the fins.

3. The cable of claim 1 wherein the variable thickness along the cross-sectional length of the given one of the fins increases from a portion of the fin adjacent the central region of the crossweb to the maximum thickness and decreases from the maximum thickness to an end of the fin away from the central region.

4. The cable of claim 3 wherein the variable thickness is at a minimum thickness at the portion of the fin adjacent the central region of the crossweb.

5. The cable of claim 1 wherein the maximum thickness is in a range of approximately 0.008 inches to 0.050 inches.

6. The cable of claim 4 wherein the minimum thickness is in a range of approximately 0.004 inches to 0.025 inches.

7. The cable of claim 1 wherein the crossweb comprises a material selected from the group consisting of fluoropolymers, polyvingy chloride, polyolefins, and zero halogen compounds.

8. The cable of claim 1 wherein the cable comprises a Category 6 network cable.

9. The cable of claim 1 wherein the cable comprises a multi-pair cable comprising a plurality of four-pair groups of conductors and a plurality of three-pair groups of conductors, the crossweb being associated with one of the four-pair groups of conductors.

10. The cable of claim 9 further comprising a plurality of crosswebs each having a plurality of fins of substantially elliptical cross-sectional shape, a given one of the crosswebs being associated with a corresponding one of the plurality of four-pair groups of conductors.

11. The cable of claim 9 wherein the cable comprises a 25-pair cable comprising four four-pair groups of conductors and three three-pair groups of conductors.

12. A cable comprising:

a plurality of twisted pairs of conductors; and a crossweb running longitudinally along at least a portion of a length of the twisted pairs of conductors, the crossweb having a central region approximately in a center of the cable and a plurality of fins extending outwardly from the central region, a given one of the fins separating at least a first one of the twisted pairs of conductors from at least a second one of the twisted pairs of conductors;

wherein at least the given one of the fins has a substantially oblong shape and a variable thickness along a cross-sectional length thereof from the central region to an opposing end of the fin with a maximum of the variable thickness being located at the intersection of the fin with an imaginary line defined by the cross-sectional centers of the twisted pairs of conductors between which the fins resides.

13. The cable of claim 12 wherein the plurality of twisted pairs of conductors comprises four twisted pairs of conductors, and the crossweb comprises four fins, with each of the four twisted pairs of conductors being arranged between a pair of the fins.

14. The cable of claim 12 wherein the variable thickness along the cross-sectional length of the given one of the fins increases from a portion of the fin adjacent the central region of the crossweb to the maximum thickness and decreases from the maximum thickness to an end of the fin away from the central region.

15. The cable of claim 14 wherein the variable thickness is at a minimum thickness at the portion of the fin adjacent the central region of the crossweb.

16. The cable of claim 12 wherein the cable comprises a Category 6 network cable.

* * * * *